US006283605B1

(12) United States Patent
Kalamaras

(10) Patent No.: US 6,283,605 B1
(45) Date of Patent: Sep. 4, 2001

(54) CONTAINER WITH COMPARTMENT AND METHOD FOR FORMING SAME

(76) Inventor: Michael P. Kalamaras, 342 Bristol La., Fox River Grove, IL (US) 60021

( * ) Notice: Subject to any disclaimer, the term of this patent is extended or adjusted under 35 U.S.C. 154(b) by 0 days.

(21) Appl. No.: 08/225,229

(22) Filed: Apr. 8, 1994

(51) Int. Cl.[7] ..... F21V 33/00

(52) U.S. Cl. ..... 362/101; 362/276; 362/806

(58) Field of Search ..... 362/96, 101, 276, 362/802, 318, 806, 812, 800; 40/406, 324; 215/6, 10; 220/504, 630; 206/508

(56) References Cited

U.S. PATENT DOCUMENTS

| | | | | |
|---|---|---|---|---|
| D. 301,001 | | 5/1989 | Kalamaras et al. . | |
| D. 301,002 | | 5/1989 | Kalamaras et al. . | |
| D. 308,456 | | 6/1990 | Kalamaras et al. . | |
| 1,561,730 | | 11/1925 | Kodama . | |
| 2,505,380 | | 4/1950 | Blefeld . | |
| 2,510,237 | | 6/1950 | Mahoney . | |
| 2,598,019 | | 5/1952 | Rosenthal et al. . | |
| 2,654,974 | | 10/1953 | Rosenthal . | |
| 2,663,866 | * | 12/1953 | Simpson | 362/101 |
| 4,239,223 | | 12/1980 | Wilson . | |
| 4,344,113 | * | 8/1982 | Ditto et al. | 362/802 |
| 4,390,928 | | 6/1983 | Runge . | |
| 4,616,304 | * | 10/1986 | Von Kohorn | 362/318 |
| 4,678,093 | | 7/1987 | Allen . | |
| 4,898,060 | | 2/1990 | To . | |
| 4,922,355 | | 5/1990 | Dietx et al. . | |
| 5,119,932 | | 6/1992 | Semanoff . | |
| 5,123,190 | | 6/1992 | Erberber . | |
| 5,125,866 | | 6/1992 | Arad et al. . | |
| 5,162,011 | | 11/1992 | Frisque . | |
| 5,211,699 | | 5/1993 | Tipton . | |

OTHER PUBLICATIONS

Howw Manufacturing Catalog.

* cited by examiner

*Primary Examiner*—Y. Quach
(74) *Attorney, Agent, or Firm*—James Creighton Wray; Meera P. Narasimhan

(57) ABSTRACT

A beverage vessel or container comprises an optically transparent housing having a cylindrical portion extending between a top circular edge and a bottom circular edge. The bottom circular edge having an inner circular recess forming an inner circular shoulder. The housing having a circular dividing platform forming an upper compartment and a lower compartment. A base having a cylindrical base portion is provided. The cylindrical base portion having an upper circular edge. The upper circular edge engaging the inner circular recess and abutting the inner circular shoulder. The base having a circular base bottom parallel to the circular dividing platform and in a spaced apart planar relation from the bottom circular edge of the cylindrical portion of the housing, so that the volume of the lower compartment is increased. Within the lower compartment, a decorative, entertaining, or refreezable device may be included.

18 Claims, 3 Drawing Sheets

CONTAINER WITH COMPARTMENT AND METHOD FOR FORMING SAME

BACKGROUND OF THE INVENTION

1. Field of the Invention

This invention generally relates to a container and, more particularly, to a container having an open compartment and a sealed base compartment. The sealed base compartment may contain therein an entertaining or advertising device, such as a battery-powered entertaining device or a motion-activated ornament.

2. Description of the Prior Art

It is known to provide a decoration on a beverage container. A typical method of decorating a beverage container is to form a compartment in the lower base thereof. This lower compartment may be applied to other containers or beverage vessels of different shapes.

Any number of features are usable in the compartment. One may place an appropriate design, decoration or device within that lower compartment. These designs or decorations can make the glass make more attractive and more of an attention getting device. With increased attention getting capabilities, the value of the beverage container or similar device, as either an entertaining medium or an advertising medium, is greatly increased. Entertaining medium or an advertising medium may be used interchangeably in the device of this invention.

One known advertising medium is a molded sheet of plastic. A shapeable sheet is an appropriately colored with one or more colors. The sheet is then shaped on a mold to create a three-dimensional shape. The size of a bottom compartment of a beverage container minimizes the use of such a molded sheet therein. Yet that use of a molded sheet is highly desirable.

However, to increase the moving capabilities of the devices in the bottom of the glass and attractiveness leads to complications. Complications lead to increase in size and a corresponding problem with fitting a desired device or design in the lower compartment of the beverage container.

For advertising, decorating, entertaining and other purposes, it is known to provide a beverage vessel having an open compartment and a sealed lower compartment. The open compartment contains a beverage desired to be consumed. The sealed lower compartment provides the lower portion of the beverage vessel.

While it is well known to put a display in the lower compartment of beverage vessel, an improvement in that field is still desirable. It is desirable to adjust the size or volume of the lower compartment of the two-compartment beverage vessel in a simple fashion so that the size of the item contained in the sealed compartment can be larger. The developing of a molding process for forming the two-compartment beverage vessel can be very costly. Therefore, it is desirable to be able to adjust the size of the lower compartment without having to create new molds for the entire beverage vessel. This provides an economical method of producing different beverage vessels to satisfy customer needs. It is also desirable to be able to increase the size of the lower compartment in such a way as to not detract from the appearance of an existing beverage vessel.

Desirable features, as described above, are not found in prior two-compartment beverage vessels. For example, U.S. Pat. No. 4,390,928 issued to Runge and U.S. Pat. No. 5,211,699 issued to Tipton disclose two-compartment containers. However, both Runge and Tipton teach the use of a flat lower panel or bottom which seals a lower compartment flush to the container. The size of the lower compartment is dictated solely by the height of the cylindrical sidewalls of a main housing that form the lower compartment. Therefore, modifications to increase the size of the lower compartment would require a changes to the container as a whole.

Another common design for a two-compartment beverage vessel involves creating a lower compartment structure that connects to the bottom of a single compartment vessel to create two compartments. This type of design is shown in U.S. Pat. No. 2,654,974, issued to Rosenthal, and U.S. Pat. No. 2,510,337 issued to Mahoney. However, in this type of design, the bottom of the lower compartment is flat and formed integral with the sides of the lower compartment. Increasing the size of this lower compartment would require modifications of this entire lower compartment section, and not simply a bottom or base member, which can be modified and produced more inexpensively. Furthermore, because the lower compartment is not formed as an continuous extension of the upper compartment, a circular seam, ridge, or edge will be present at a point where the two compartment sections connect. This seam, ridge, or edge will be visible from any side view of the vessel and will detract from its appearance.

It is furthermore desired to provide for the option of having a wide variety of devices in the sealed compartment. This adjustability in size of the lower compartment combined with the wide variety of devices placeable therein inherently provides for a more entertaining device or beverage vessel.

SUMMARY OF THE INVENTION

In accordance with one embodiment of the invention a beverage vessel or container comprises an optically transparent housing having a cylindrical portion extending between a top circular edge and a bottom circular edge. The bottom circular edge having an inner circular recess forming an inner circular shoulder. The housing having a circular dividing platform forming an upper compartment and a lower compartment. The lower compartment having a volume determined approximately by a height between the bottom circular edge and the circular dividing platform and a diameter of the cylindrical portion. A base having a cylindrical base portion is provided. The cylindrical base portion having an upper circular edge. The upper circular edge engaging the inner circular recess and abutting the inner circular shoulder. The base having a circular base bottom parallel to the circular dividing platform and in a spaced apart planar relation from the bottom circular edge of the cylindrical portion of the housing, so that the volume of the lower compartment is increased by an amount determined approximately by second height between the bottom circular edge and the circular base bottom and a diameter of the cylindrical base portion. Within the lower compartment, a decorative, entertaining, or refreezable device may be included.

In another embodiment, a beverage vessel or container comprises an optically transparent housing having a cylindrical portion extending between a top circular edge and a bottom circular edge. The bottom circular edge having an inner circular recess forming an inner circular shoulder. The housing having a circular dividing platform forming an upper compartment and a lower compartment. A cylindrical spacer having an upper circular spacer edge is provided. The upper circular spacer edge engaging the inner circular recess and abutting the inner circular shoulder. The cylindrical spacer having a threaded outer portion below the upper circular spacer edge. A threaded base having a cylindrical base portion is also provided. The cylindrical base portion having a threaded inner portion threadably engaging the threaded outer portion of the cylindrical spacer. The threaded base having a circular base bottom parallel to the circular dividing platform and in a spaced apart planar relation from the bottom circular edge of the cylindrical portion of the housing, so that the volume of the lower compartment is increased.

A method of producing a two-compartment beverage vessel or container is provided. The beverage vessel has a lower compartment formed as a continuous extension of an upper compartment. The lower compartment being increasable in size without having to modifying an optically transparent housing that forms the upper compartment and the lower compartment. The method comprising the steps of: molding the optically transparent housing having a cylindrical portion, the housing having a circular dividing platform forming the upper compartment and the lower compartment; molding a base that will increase the size of the lower compartment when the base is connected to the housing; inserting means for attracting attention into the lower compartment of the beverage vessel; and sealing the lower compartment by connecting the base to the housing.

A further objective of this invention is to provide a beverage vessel having a sealable compartment therein.

A still further objective of this invention is to provide a beverage vessel having a light-emitting device in the base thereof.

Yet a further objective of this invention is to provide a beverage vessel having a sound-emitting device in the base thereof.

Also an objective of this invention is to provide a beverage vessel having a battery-powered device in the base thereof.

Another objective of this invention is to provide a beverage vessel having a movement-causing device in the base thereof.

Still another objective of this invention is to provide a beverage vessel having an entertaining device caused to operate by motion.

A further objective of this invention is to provide a beverage vessel having a freezable mass within the sealable compartment.

Yet a further objective of this invention is to provide a method for forming a beverage vessel with a removable sealable base.

Also an objective of this invention is to provide a method for forming beverage vessel with a variety of entertaining devices in the base thereof.

A further objective of this invention is to provide a bowl having a sealable compartment therein.

A still further objective of this invention is to provide a bowl having a light-emitting device in the base thereof.

Yet a further objective of this invention is to provide a bowl having a sound-emitting device in the base thereof.

Also an objective of this invention is to provide a bowl having a battery-powered device in the base thereof.

Another objective of this invention is to provide a bowl having a movement causing device in the base thereof.

Still another objective of this invention is to provide a bowl having entertaining device caused to operate by motion.

A further objective of this invention is to provide a bowl having a freezable mass within the sealable compartment.

Yet a further objective of this invention is to provide a method for forming a beverage vessel with a sealable base.

These and other objects of the invention may be had by referring to the following detailed description and claims taken in conjunction with the accompanying drawings.

Figure 1:
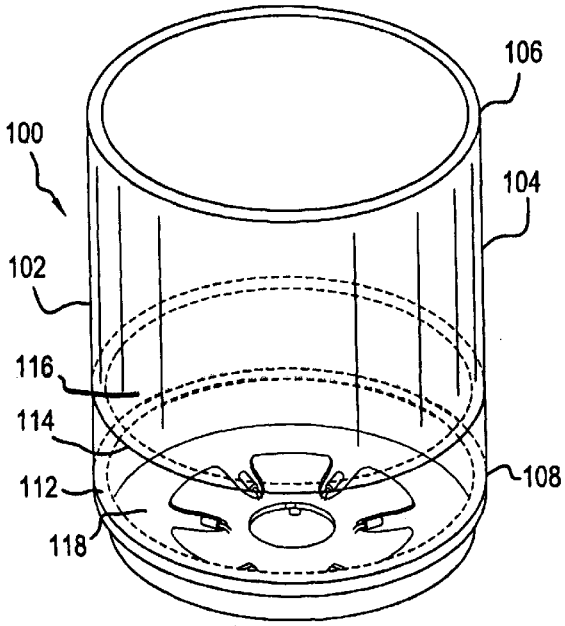
FIG. 1 depicts a perspective view of the two-compartment beverage vessel.
Figure 3:
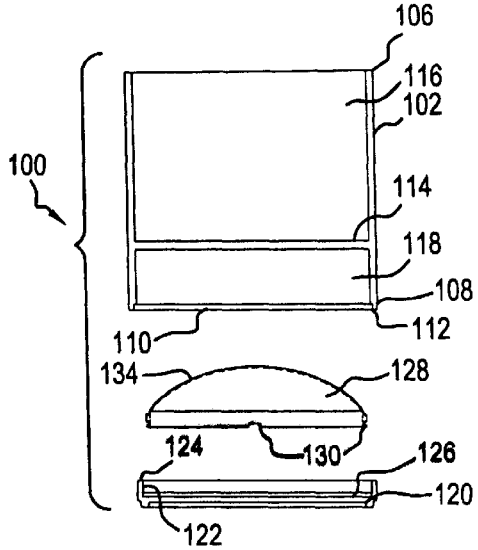
FIG. 3 depicts an exploded side view of the two-compartment beverage vessel and further shows a vacuum formed member capable of being inserted into a lower compartment.

It is be noted that those lines within perspective figures which are equally spaced apart are for purposes of giving a three-dimensional appearance and are not indicative of structural aspects.

DESCRIPTION OF THE PREFERRED EMBODIMENTS

A beverage vessel having a sealable lower compartment and an open upper compartment can receive a display such as an entertaining device or advertising device in the sealable lower compartment. The sealable lower compartment is closed by a base with cylindrical sides having a varying length.

This device is also permits a bowl shape or a stemmed glass to be used. It is also possible to secure the lower compartment with a male or a female threaded member.

It is also possible to print a sheet with a desired design and mold or otherwise shape the sheet to the appropriate type of device. For example, the printed copy could be placed on the sheet. The sheet could then be molded so as to create a three dimensional effect for advertising or other suitable purposes. In this fashion, the advantages of the adjustable size compartment glass become apparent.

One suitable entertaining device has a mounting surface including a motion switch connected to a battery to provide the power for one particular entertaining device of this invention. The powered entertaining device can be a light or series of lights, a device for producing sound, a motion-producing entertaining device or similar item.

In particular, the mounting board having the battery and switch electrically connected therein may also be connected to one or more lights. The one or more lights may be wired in standard fashion to flash on and off at alternate times or to be constantly on.

The motion switch therein permits the light-emitting device to be activated or turned on as the cup or beverage container is in use. Upon leaving the cup or beverage container at rest for a period of time, the lights can deactivate or turn off, until the motion switch is again operated.

It is also possible and even preferred to insert a timing switch into the circuit. The timing switch requires that the motion switch be reactivated to start whatever device is in the circuit, whether it be the lights, or the sound or the motion.

It is also possible to have a freezable or refreezable liquid in the lower compartment of the container. With this action, the two-compartment beverage container maybe be used to keep the beverage cold.

The motion switch combined with the solid state circuitry permits the two-compartment beverage container to provide decoration or advertisement. Having the sound mechanism be either a small record player or small compact disc or similar device is possible. Even a synthesized voice device may be used.

A small motor can be contained therein for producing movement of desired nature. The motion switch provides for movement at selected times. The action can be stopped by a timing switch or the motion switch. A resealable battery chamber can be provided in the lower compartment to provide for replacement of the battery as desired.

The lights may be replaced by a sound recording. The lights may also be replaced by a small electric motor which can move any number of entertaining devices in a reasonable fashion to achieve the desired attractiveness.

The lights may be used to highlight a sign or other advertising message. The lights may also be purely decorative. If there is a series of lights, each light is activated by the battery when powered by the switch. These connections are in standard fashion.

The lights may be intermittent and provide for a flashing light arrangement. The intermittent structure may also be accomplished in any number of other ways. However, it is preferred that the bulbs contain within themselves the flashing mechanism turning the light on and off as long as the electric power from the battery is applied to the bulb.

In a similar fashion the electric motor for the small entertaining device may be powered on a routine basis. Likewise the sound recording may be adapted to play an appropriate tune. The tunes, of course, can vary with the season of the year. The sound producing entertaining device is any standard miniaturized entertaining device commonly available and known to one skilled in the art.

The circuit board is any commonly available circuit board shaped to the specifications to meet the two-compartment beverage container lower compartment size. The battery and the motion switch combined with the lights or other devices may be wired or connected therein in any standard fashion.

With the structure as set forth, the motion switch is mounted in the board. The board is wired or solid state connected to the battery and to all desired activated materials.

Once this assembly is obtained, it is inserted into the lower compartment of a beverage container. The beverage container may be sealed in any standard fashion to achieve the desired results. It is to be understood that an assembly as described above may be able to rest in a cylindrical chamber of the base which is that portion of the base that increases the overall size of the lower compartment. Therefore, the rest of the lower chamber can be used to house another form of a decorative or entertaining device.

Referring now to FIG. 1, beverage vessel 100 has an optically transparent housing 102 having a cylindrical portion 104 extending between a top circular edge 106 and a bottom circular edge 108. The bottom circular edge 108 has an inner circular recess 110 forming an inner circular shoulder 112. The housing 102 also has a circular dividing platform 114 formed integral therewith. The circular dividing platform 114 forms an upper compartment 116 and a lower compartment 118. The lower compartment 118 has a volume determined approximately by the height between the bottom circular edge 108 and the circular dividing platform 114 and the diameter of the cylindrical portion 104.

The housing 102 is preferably formed by a molding process from an acrylic plastic. An acrylic plastic is preferred because is it both clear and more rigid than other plastics. However, it is to be understood that other materials could equally be used.

Figure 2:
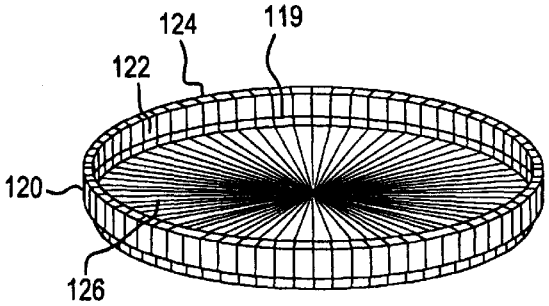
FIG. 2 depicts a perspective view of the base for the two-compartment beverage vessel.

As best illustrated in FIG. 2, a base 120 is provided. The base 120 has cylindrical base portion 122. The cylindrical base portion 122 has an upper circular edge 124. The upper circular edge 124 engages the inner circular recess 110 from below the housing 102 and abuts the inner circular shoulder 112. The base 120 has a circular base bottom 126 parallel to the circular dividing platform 114 and in a spaced apart planar relation from the bottom circular edge 108 of the cylindrical portion 104 of the housing, so that the volume of the lower compartment 118 is increased by an amount determined approximately by second height between the bottom circular edge 108 and the circular base bottom 126 and a diameter of the cylindrical base portion 122.

The base 120 is preferably formed by a molding process from an acrylic plastic. Different colors can also be applied to the acrylic plastic so that the base 120 can formed in an array of different color choices. It is highly preferred that the base 120 be sonically welded to the housing 102. However other securing methods are operable, even though not as efficient as sonic welding.

As illustrated in FIGS. 3 and 5–7, the beverage vessel 100 may also contain a vacuum formed member 128. The vacuum formed member 128 may have means for connecting the vacuum formed member 128 to the base 120 within the lower compartment 118 of the housing 102.

In a preferred embodiment, the means for connecting the vacuum formed member 128 to the base 120 within the lower compartment 118 of the housing 102 is a plurality of small synthetic plastic pins 130 formed integral with a sidewall circular edge 132 of the vacuum formed member 128. The pins 130 being compressed against an inner wall of the cylindrical base portion 122 to create friction which secures the vacuum formed member 128 to the base 120.

Figure 6:
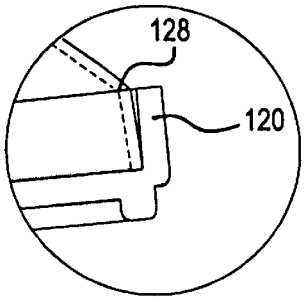
FIG. 6 depicts a fragmentary exploded partial side view of the orientation of the vacuum formed member and the base after assembly.
Figure 7:
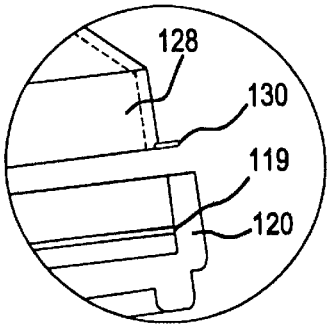
FIG. 7 depicts a fragmentary exploded partial side view of the orientation of the vacuum formed member and the base prior to assembly.

FIG. 7 illustrates a fragmentary exploded partial side view of the orientation of a portion of the vacuum formed member 128 and the base 120 prior to assembly. FIG. 6 depicts a fragmentary exploded partial side view of the orientation of the vacuum formed member 128 and the base 120 after assembly. In this embodiment, the pins 130 are essentially nonresilient and are shown to fold against the inner wall of the cylindrical base portion. However, it is to understood that pins which compress or fold in other fashions can be equally as effective. For example, the providing of a circular flange 119 in the inner wall of the cylindrical base portion 122 for engagement with the pins 130.

An entertaining device may be mounted within the vacuum formed member 128. Furthermore, a printing may attached to an outer surface 134 of the vacuum formed member 128. Preferably, the vacuum formed member 128 is formed by a molding process and is constructed of light gauge styrene plastic. The styrene plastic will allow for a four color printing process to be applied thereto. A design, logo, or other mark could be then printed upon the vacuum formed member 128, while at the same time concealing an entertaining device below. Furthermore, it is to be understood that the vacuum formed member 128 could be shaped in a mold to have any possible predetermined configuration.

Figure 12:
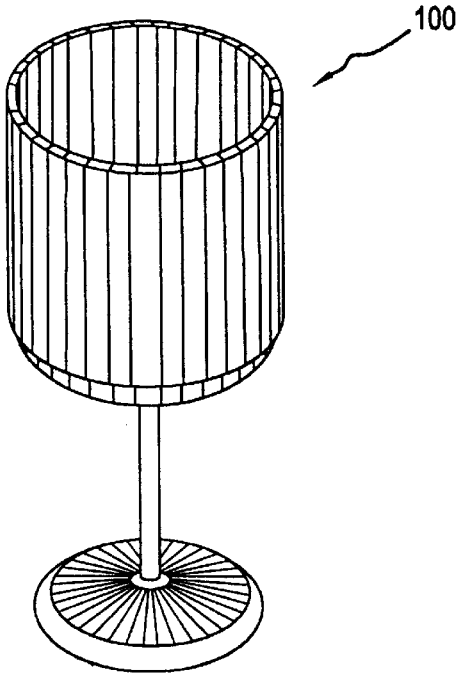
FIG. 12 depicts a perspective view of a two-compartment stemmed glass.
Figure 13:
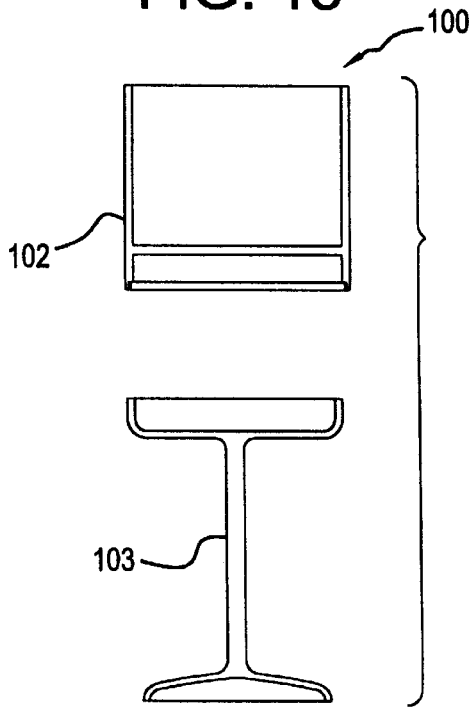
FIG. 13 depicts an exploded side view of the two-compartment stemmed glass.
Figure 14:
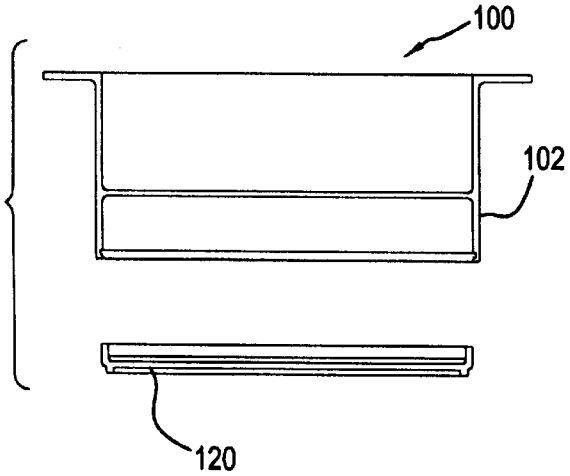
FIG. 14 depicts an exploded side view of a two-compartment bowl.
Figure 15:
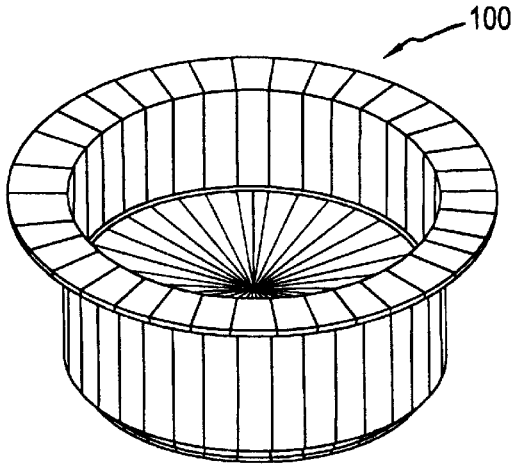
FIG. 15 depicts a perspective view of the two-compartment bowl.

The beverage vessel 100 could also be formed in the shape of a bowl, as shown in FIGS. 12–13, or a stemmed glass, as shown in FIGS. 14–15. In the case of a stemmed glass, the base 120 would have a stemmed housing 103 joined to a bottom side of the base 120 and formed as a continuous extension thereof. It is also to be understood that a handle could be connected to any of the embodiments described. The handle could be either separately connected to the housing 102 or formed integral therewith.

Figure 11:
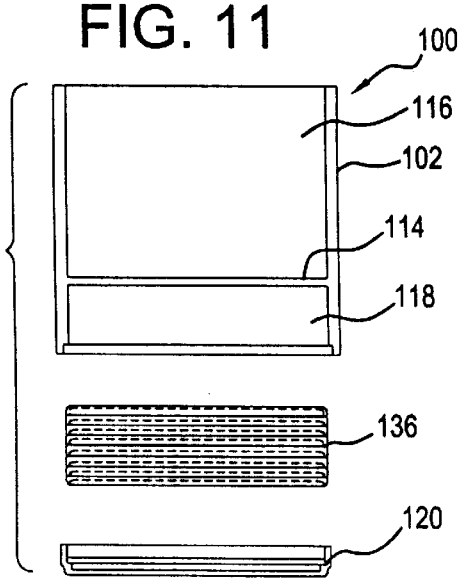
FIG. 11 depicts an exploded side view of a refreezable package used in a lower compartment of the two-compartment beverage vessel.

As illustrated in FIG. 11, a freezable or a refreezable device 136 could be inserted into the lower compartment 118 of the beverage vessel 100 to keep a liquid contained in the upper compartment 116 cooled. The beverage vessel 100 could be placed in a freezer or cooler to refreeze the device 136.

Figure 4:
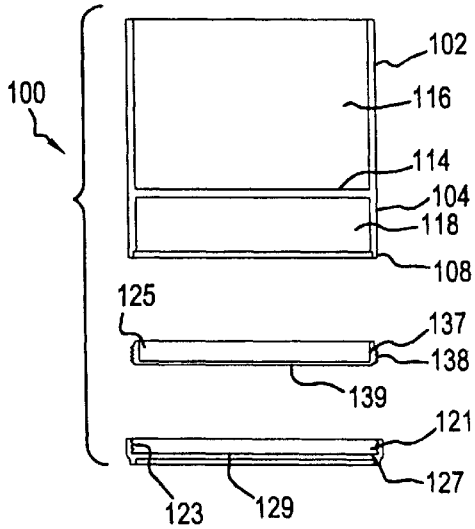
FIG. 4 depicts an exploded side view of the two-compartment beverage vessel having a threaded spacer and a removable threaded base.
Figure 5:
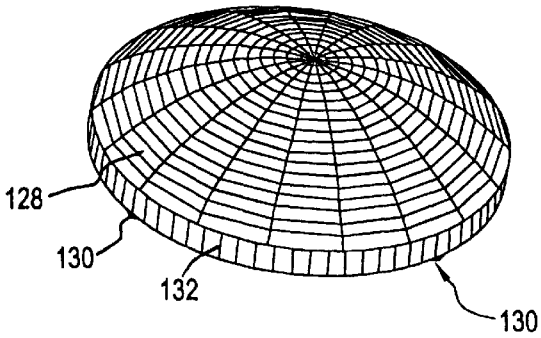
FIG. 5 depicts a perspective view of the vacuum formed member.

In an alternative embodiment, the beverage vessel 100 may utilize a threaded spacer 137 having an upper circular spacer edge 125, as shown in FIG. 4. The upper circular spacer edge 125 engaging the inner circular recess 110 and abutting the inner circular shoulder 112. The cylindrical spacer 137 having a threaded outer portion 138 below the upper circular spacer edge 125.

A threaded base 121 having a cylindrical base portion 123 is provided. The cylindrical base portion 123 having a threaded inner portion 127 threadably engaging the threaded outer portion 138 of the cylindrical spacer 137. The threaded base 121 having a circular base bottom 129 parallel to the circular dividing platform 114 and in a spaced apart planar relation from the bottom circular edge 108 of the cylindrical portion 104 of the housing 102, so that the volume of the lower compartment 118 is increased by an amount determined approximately by second height between the bottom circular edge 108 and the circular base bottom 129 and a diameter of the cylindrical base portion 123.

It is to understood that the threaded spacer 137 may be formed integral with the housing 102. In addition, means for water tight sealing between the threaded spacer 137 and threaded base 121 may be provided. For example, an O-ring or washer 139 of conventional design could be utilized. A groove or recess could be formed for secured engagement of the O-ring or washer 139. In another embodiment, a decorative or entertaining device inserted in the lower compartment 118 may allow for a hidden compartment adjacent to the threaded base 121 within the lower compartment 118. The hidden compartment would be accessible by removal of the threaded base 121 and could be used to store or hide a number of small objects such as keys or money.

A method of producing a two-compartment beverage vessel 100 that has a lower compartment 118 formed as a continuous extension of an upper compartment 116 is also provided. The lower compartment 118 being increasable in size without having to modifying an optically transparent housing 102 that forms the upper compartment 116 and the lower compartment 118, comprising the steps of: molding the optically transparent housing 102 having a cylindrical portion 104, the housing 102 having a circular dividing platform 114 forming the upper compartment 116 and the lower compartment 118, molding a base 120 that will increase the size of the lower compartment 118 when the base 120 is connected to the housing 120, inserting means for attracting attention into the lower compartment 118 of the beverage vessel 100, and sealing the lower compartment 118 by connecting the base 120 to the housing 102. The step of sealing the lower compartment is preferably comprised of sonically welding the the base 120 to the housing 102.

The method may additionally comprise the steps of printing on an outer surface 134 of a vacuum formed member 128, and inserting the vacuum formed member 128 into the lower compartment 118, so as to conceal the means for attracting attention. The means for attracting attention may be a decorative or entertaining device as described below.

Figure 8A:
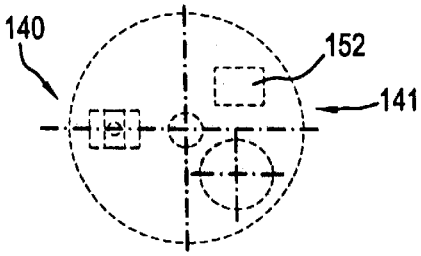
FIG. 8 depicts a circuit diagram for a light-emitting device.
Figure 8B:
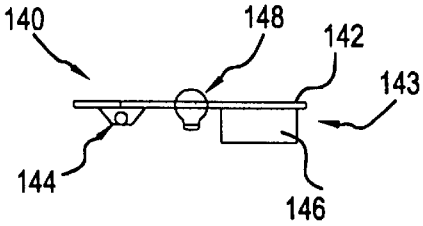

Turning now to one type of entertainment device for use in the lower compartment 118 for all of the previously described embodiments, FIG. 8 depicts a circuit diagram for the light-emitting device 140. A top view 141 and a side view 143 of the light-emitting device 140 is shown in FIG. 8.

The light-emitting device 140 has a solid-state circuit board 142 with a motion switch 144 connected to a battery 146 in a standard fashion to provide the power therefor. Connected to solid-state circuit board 142, the motion switch 144 and the battery 146 in a standard fashion is a series of light emitting diodes 148.

The one or more light-emitting diodes 148 may be wired in standard fashion to flash on and off at alternate times or to be constantly on. Within the light-emitting diodes 148 themselves may be a suitable flashing structure. The motion switch 144 may also cause the flashing. The use of the solid state circuitry permits the light-emitting device 140 to fit into the lower compartment 118.

The motion switch 144 permits the light-emitting device 140 to be activated as the cup or beverage container 100 is in use. Upon leaving the cup or beverage container 100 at rest for a period of time, the light-emitting diodes 148 can deactivate, until the motion switch 144 is again operated. Timing switch 152 can also terminate light-emitting diodes 148 or other elements, which can be used.

Figure 9:
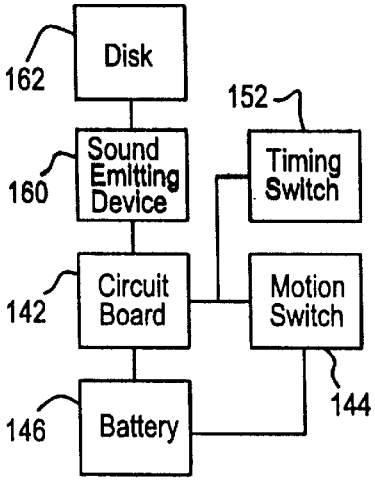
FIG. 9 depicts a block diagram for a sound-emitting device.

In FIG. 9, the light-emitting device 140 is replaced with the sound-emitting device 160 of suitable size to fit into the lower compartment, as shown in block diagram form, the structure of FIG. 8 making it clear how to achieve the desired modification. Sound-emitting device 160 can play a small disk 162 having any suitable sound or music recorded thereon. If the structure of FIG. 4 is used, the music and battery can be changed easily.

Figure 10:
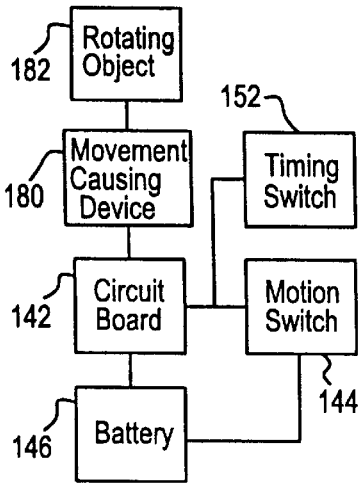
FIG. 10 depicts a block diagram for a movement-causing device.

In FIG. 10, the light-emitting device 140 is replaced by movement-causing device 180. Rotating object 182 provides movement and eye-catching entertainment. The circuitry is similar to light-emitting device 140. It is also possible to insert more than one entertainment device in the lower compartment 118. Again, the structure of FIG. 8 makes it clear how to achieve the desired modification. It is also possible to have the entertaining devices described above to be attached to the base 120 in an orientation so that the entertaining device is flush or below the plane created by the upper circular edge 124 of the base 120.

In addition to or in place of the entertaining device, a decorative device could be equally used. The decorative device could also incorporate an advertising medium. Furthermore, it is contemplated that more than one entertaining or decorative device could be implemented.

Although the invention has been described by reference to some embodiments it is not intended that the novel apparatus be limited thereby, but that modifications thereof are intended to be included as falling within the broad scope and spirit of the foregoing disclosure, the following claims and the appended drawings.

I claim:

1. Apparatus for beverages comprising a beverage vessel having:

(a) an optically transparent housing having a cylindrical portion extending between a top circular edge and a bottom circular edge, the bottom circular edge having an inner circular recess forming an inner circular shoulder, the housing having a circular dividing platform forming an upper compartment and a lower compartment of the beverage vessel, the lower compartment having a volume determined approximately by a height between the bottom circular edge and the circular dividing platform and a diameter of the cylindrical portion, and (b) a base having a cylindrical base portion, the cylindrical base portion having an upper circular edge, the upper circular edge engaging the inner circular recess and abutting the inner circular shoulder, the base having a circular base bottom parallel to the circular dividing platform and in a spaced apart planar relation from the bottom circular edge of the cylindrical portion of the housing so that the volume of the lower compartment is increased by an amount determined approximately by second height between the bottom circular edge and the circular base bottom and a diameter of the cylindrical base portion and wherein a volume of the upper compartment is greater than the volume of the lower compartment of the beverage vessel.

2. The beverage vessel of claim 1, further comprising:

(a) an entertaining device operatively connected to the base within the lower compartment;

(b) means to activate the entertaining device being operatively connected to the entertaining device; and (c) means to deactivate the entertaining device being operatively connected to the entertaining device.

3. A beverage vessel comprising:

(a) an optically transparent housing having a cylindrical portion extending between a top circular edge and a bottom circular edge, the bottom circular edge having an inner circular recess forming an inner circular shoulder, the housing having a circular dividing platform forming an upper compartment and a lower compartment, the lower compartment having a volume determined approximately by a height between the bottom circular edge and the circular dividing platform and a diameter of the cylindrical portion; and (b) a base having a cylindrical base portion, the cylindrical base portion having an upper circular edge, the upper circular edge engaging the inner circular recess and abutting the inner circular shoulder, the base having a circular base bottom parallel to the circular dividing platform and in a spaced apart planar relation from the bottom circular edge of the cylindrical portion of the housing, so that the volume of the lower compartment is increased by an amount determined approximately by a second height between the bottom circular edge and the circular base bottom and a diameter of the cylindrical base portion;

(c) an entertaining device operatively connected to the base within the lower compartment, the entertaining device being a plurality of lights capable of intermittent flashing;

(d) means to activate the entertaining device being operatively connected to the entertaining device, the means to activate the entertaining device including a motion switch; and (e) means to deactivate the entertaining device being operatively connected to the entertaining device, the means to deactivate the entertaining device including a timing switch.

4. A beverage vessel comprising:

(a) an optically transparent housing having a cylindrical portion extending between a top circular edge and a bottom circular edge, the bottom circular edge having an inner circular recess forming an inner circular shoulder, the housing having a circular dividing platform forming an upper compartment and a lower compartment, the lower compartment having a volume determined approximately by a height between the bottom circular edge and the circular dividing platform and a diameter of the cylindrical portion; and (b) a base having a cylindrical base portion, the cylindrical base portion having an upper circular edge, the upper circular edge engaging the inner circular recess and abutting the inner circular shoulder, the base having a circular base bottom parallel to the circular dividing platform and in a spaced apart planar relation from the bottom circular edge of the cylindrical portion of the housing, so that the volume of the lower compartment is increased by an amount determined approximately by a second height between the bottom circular edge and the circular base bottom and a diameter of the cylindrical base portion;

(c) a vacuum formed member; and (d) means for connecting the vacuum formed member to the base within the lower compartment of the housing.

5. The beverage vessel of claim 4, wherein the means for connecting the vacuum formed member to the base within the lower compartment of the housing is a plurality of small synthetic plastic pins formed integral with a sidewall circular edge of the vacuum formed member, the pins being compressed against an inner wall of the cylindrical base portion to create friction which secures the vacuum formed member to the base.

6. The beverage vessel of claim 4, further comprising an entertaining device mounted within the vacuum formed member and a printing attached to an outer surface of the vacuum formed member.

7. A beverage vessel comprising:

(a) an optically transparent housing having a cylindrical portion extending between a top circular edge and a bottom circular edge, the bottom circular edge having an inner circular recess forming an inner circular shoulder, the housing having a circular dividing platform forming an upper compartment and a lower compartment, the lower compartment having a volume determined approximately by a height between the bottom circular edge and the circular dividing platform and a diameter of the cylindrical portion;

(b) a base having a cylindrical base portion, the cylindrical base portion having an upper circular edge, the upper circular edge engaging the inner circular recess and abutting the inner circular shoulder, the base having a circular base bottom parallel to the circular dividing platform and in a spaced apart planar relation from the bottom circular edge of the cylindrical portion of the housing, so that the volume of the lower compartment is increased by an amount determined approximately by a second height between the bottom circular edge and the circular base bottom and a diameter of the cylindrical base portion;

(c) a vacuum formed member;

(d) means for connecting the vacuum formed member to the base within the lower compartment of the housing;

(e) a printing attached to an outer surface of the vacuum formed member;

(f) an entertaining device operatively connected to the base within the lower compartment and concealed by the vacuum formed member;

(g) means to activate the entertaining device being operatively connected to the entertaining device; and (h) means to deactivate the entertaining device being operatively connected to the entertaining device.

8. The beverage vessel of claim 7, wherein the means for connecting the vacuum formed member to the base within the lower compartment of the housing is a plurality of small synthetic plastic pins formed integral with a sidewall circular edge of the vacuum formed member, the pins being compressed against an inner wall of the cylindrical base portion to create friction which secures the vacuum formed member to the base.

9. A method of producing a two compartment beverage vessel that has a lower compartment formed as a continuous extension of an upper compartment, the lower compartment being increasable in size without having to modify an optically transparent housing that forms the upper compartment and the lower compartment, comprising the steps of:

(a) molding the optically transparent housing having a cylindrical portion, the housing having a cylindrical housing wall and circular dividing platform formed within the cylindrical housing wall forming the upper compartment and the lower compartment;

(b) molding a base having a circular base platform and a cylindrical base wall thereby increasing a volume of the lower compartment when the base is connected to the housing;

(c) inserting means for attracting attention into the lower compartment of the beverage vessel such that the means for attracting attention is visible through the lower compartment; and (d) sealing the lower compartment by connecting the base to the housing by connecting a lower end edge of the cylindrical housing wall to an upper end edge of the cylindrical base wall.

10. The method of claim 9, wherein the means for attracting attention to the beverage vessel comprises:

(a) an entertaining device operatively connected to the base within the lower compartment;

(b) means to activate the entertaining device being operatively connected to the entertaining device; and (c) means to deactivate the entertaining device being operatively connected to the entertaining device.

11. A method of producing a two-compartment beverage vessel that has a lower compartment formed as a continuous extension of an upper compartment, the lower compartment being increasable in size without having to modify an optically transparent housing that forms the upper compartment and the lower compartment, comprising the steps of:

(a) molding the optically transparent housing having a cylindrical portion, the housing having a circular dividing platform forming the upper compartment and the lower compartment;

(b) molding a base that will increase the size of the lower compartment when the base is connected to the housing;

(c) inserting means for attracting attention into the lower compartment of the beverage vessel;

(d) printing on an outer surface of a vacuum formed member;

(e) inserting the vacuum formed member into the lower compartment so as to conceal the means for attracting attention; and (f) sealing the lower compartment by connecting the base to the housing, wherein sealing the lower compartment comprises the step of sonically welding the base to the housing.

12. The method of claim 11, wherein the step of inserting the vacuum formed member into the lower compartment comprises the step of compressing a plurality of essentially nonresilient synthetic plastic pins formed integral with the vacuum formed member into an inner wall of a cylindrical base portion of the base to secure the vacuum formed member by friction.

13. Beverage apparatus comprising a vessel having a transparent housing with opposite open ends, a separator forming first and second compartments in the housing of the vessel, the first compartment having a volume greater than the second compartment, first and second ends respectively on edges of the first and second compartments, a recess forming a shoulder along the second end of the housing of the vessel, a base having upper and lower ends, an edge along the upper end complementary to and abutting the shoulder in the housing of the vessel, and a volume of the lower compartment with the base being greater than a volume of the lower compartment prior to assembly of the base on the housing.

14. The apparatus of claim 13, wherein the housing of the vessel is cylindrical.

15. The apparatus of claim 14, wherein the first and second ends and the upper and lower ends, the separator, the shoulder, and the base are circular.

16. The apparatus of claim 13, further comprising beverages receivable in the first compartment of the vessel.

17. The apparatus of claim 13, wherein the volume of the first and second compartments is determined by walls of the housing, the first and second ends and the separator.

18. The apparatus of claim 13, further comprising at least one entertainment device in the second compartment between the separator and the base for drawing attention to the device.

* * * * *